US005610118A

United States Patent [19]

Smith

[11] Patent Number: 5,610,118

[45] Date of Patent: Mar. 11, 1997

[54] ABRASION RESISTANT THERMOSENSITIVE RECORDING ELEMENT

[75] Inventor: Albert H. Smith, Carrollton, Tex.

[73] Assignee: International Paper Company, Purchase, N.Y.

[21] Appl. No.: 366,395

[22] Filed: Dec. 29, 1994

Related U.S. Application Data

[63] Continuation of Ser. No. 179,542, Jan. 3, 1994, abandoned, which is a continuation of Ser. No. 781,557, Oct. 22, 1991, abandoned.

[51] Int. Cl.[6] ..... B41M 5/28

[52] U.S. Cl. ..... 503/214; 427/152; 503/216; 503/217; 503/220; 503/221; 503/226

[58] Field of Search ..... 503/200, 226, 503/214, 216, 217, 220, 221; 427/150, 152

[56] References Cited

U.S. PATENT DOCUMENTS

| | | | |
|---|---|---|---|
| 4,020,232 | 4/1977 | Kohmura et al. | 503/226 |
| 4,401,721 | 8/1983 | Hida | 503/226 |
| 5,418,206 | 5/1995 | Smith | 503/209 |

FOREIGN PATENT DOCUMENTS

| | | |
|---|---|---|
| 57-133094 | 8/1982 | Japan . |
| 61-074885 | 4/1986 | Japan . |
| 61-066687 | 4/1986 | Japan . |
| 2110399 | 6/1983 | United Kingdom . |

*Primary Examiner*—Pamela R. Schwartz
*Attorney, Agent, or Firm*—Ostrager, Chong & Flaherty

[57] ABSTRACT

A thermosensitive recording element having improved abrasion resistance, said element comprising (a) a support; (b) a first layer comprising an organic polymeric binder and either a substantially colorless electron donating dye precursor or an electron accepting compound or mixtures thereof; and (c) a second layer comprising an organic polymeric binder compatible with the binder in (b) and either a substantially colorless electron donating dye precursor or an electron accepting compound, wherein both dye precursor and electron accepting compound are present in the element and wherein the first layer is interposed between the support and second layer. These elements have wide application in the printing industry.

24 Claims, No Drawings

ABRASION RESISTANT THERMOSENSITIVE RECORDING ELEMENT

This is a continuation of application Ser. No. 08/179,542 filed on Jan. 3, 1994, now abandoned, which is a continuation of Ser. No. 07/781,557 filed on Oct. 22, 1991, now abandoned.

FIELD OF THE INVENTION

This invention relates to thermosensitive recording elements and, in particular, to thermosensitive recording elements having improved abrasion resistance. This invention also concerns a process for preparing thermosensitive recording elements having improved abrasion resistance.

BACKGROUND OF THE INVENTION

Thermosensitive recording elements have wide application in the printing industry. For example, thermosensitive recording elements have been used in recording instruments for measurements, such as facsimiles, printers, thermal devices for computers, devices for preparing architectural and engineering drawings, vending machines for dispensing railroad tickets and luggage tags, and thermal label printing devices. Conventional thermosensitive recording elements generally comprise a support and one thermosensitive recording layer provided thereon. The thermosensitive recording layer primarily contains a binder, a substantially colorless electron donating dye precursor and an electron accepting compound also known as a developer. Upon heating, by means of a thermal head, a thermal pen or laser beam, the dye precursor instantaneously reacts with the electron accepting compound to form a recorded image.

It has been found that defects in the imaging surface of thermosensitive recording elements can be easily obtained. For example, rubbing the element gently with hard objects such as paper clips, fingernails and dirt particles or even by folding the element can result in undesirable imprints in the imaging surface. This presents a barrier to their use as facsimile papers, architectural engineering drawings, luggage tags, thermal printed labels, and the like. Defects in the imaging surface are also obtained during the preparation process. Thermal coatings are typically prepared by mixing certain dye precursors and developers together to form a single coating composition. A color forming reaction may occur at room temperature leading to coatings that have varying degrees of grayness in the undeveloped background areas.

Accordingly, a need exists for a thermosensitive recording element having improved abrasion resistance. It has been found that the thermosensitive recording element provided by the present invention, overcomes the above identified deficiencies and leads to abrasion resistant, whiter, i.e., less gray, thermosensitive recording elements, and also extends the useful life of the coating compositions prior to their use.

SUMMARY OF THE INVENTION

The present invention provides a thermosensitive recording element having improved abrasion resistance comprising:

(a) a support;

(b) a first layer comprising an organic polymeric binder and either a substantially colorless electron donating dye precursor, an electron accepting compound, or mixtures thereof; and (c) a second layer comprising an organic polymeric binder compatible with the binder in (b) and either a substantially colorless electron donating dye precursor or an electron accepting compound, wherein both dye precursor and electron accepting compound are present in the element, and wherein the first layer is interposed between the support and the second layer.

In another embodiment of the invention, there is provided, a process for preparing a thermosensitive recording element having improved abrasion resistance comprising the steps of:

(a) providing a support;

(b) preparing a first dispersion of an aqueous solution comprising an organic polymeric binder, and a substantially colorless, electron donating dye precursor;

(c) preparing a second dispersion of an aqueous solution comprising an organic polymeric binder, and an electron accepting compound, wherein the binder is compatible with the binder in (b);

(d) applying either the first or second dispersion or a mixture thereof onto the support;

(e) drying the first applied dispersion to form a first layer on the support;

(f) applying either the first or second dispersion on the layer formed in step (e); and (g) drying the second applied dispersion to form a second layer.

DETAILED DESCRIPTION OF THE INVENTION

Surprisingly and unexpectedly, it was found that separating the electron donating dye precursor from the electron accepting compound into two separate layers, wherein the outermost or second layer does not contain both dye precursor and electron accepting compound, produced a thermosensitive recording element having white, i.e., non-gray, coatings and improved abrasion resistance.

The thermosensitive recording element of the invention comprises (a) a support; (b) a first layer comprising a binder and either a substantially colorless electron donating dye precursor, an electron accepting compound, or mixtures thereof; and (c) a second layer comprising an organic polymeric binder compatible with the binder in (b) and a substantially colorless electron donating dye precursor or an electron accepting compound. The first layer is interposed between the support and the second layer. The binder in both layers is an organic polymeric binder, and preferably both layers contain the same binder. Further, both dye precursor and electron accepting compound must be present in the element. However, in order to obtain an abrasion resistant thermosensitive element, it is important that the second layer or the outermost layer, contain either the dye precursor or electron accepting compound and not both.

ELECTRON DONATING DYE PRECURSOR

The thermosensitive recording element of the invention contains a substantially colorless electron donating dye precursor which is present in either the first or second layers of the thermosensitive recording element. By the term "substantially colorless" it is meant having a background optical density less than or equal to 0.10. Electron donating dye precursors that are used in ordinary pressure-sensitive recording papers, thermosensitive recording papers, etc., are useful in the present invention. Suitable electron donating dye precursors are disclosed in U.S. Pat. Nos. 4,889,841 issued to Kosaka et al., 4,885,271 issued to Kawakami et al., and 4,467,336 issued to Koike. Specific examples include:

(1) triarylmethane compounds such as 3,3-bis(p-dimethylaminophenyl)-6-dimethylaminophthalide (Crystal Violet lactone), 3,3-bis(p-dimethylamino-phenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl-(3-(2-phenylindol-3-yl)phthalide, 3-3-bis(2-dimethyl-indol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.;

(2) diphenylmethane compounds such as 4,4'-bis-dimethylaminobenzhydryl benzyl ether, N-halophenyl leuco Auramine, N-2,4,5-trichlorophenyl leuco Auramine, etc.;

(3) xanthene compounds such as Rhodamine B anilinolactam, Rhodamine B p-chloroanilinolactam, 3-diethylamino-7-dibenzylaminofluoran, 3-diethylamino-7-octylaminofluoran, 3-diethylamino-7-(3,4-dichloroanilino)fluoran, 3-diethylamino-7-(2-chloroanilino)fluoran, 3-diethylamino-6-methyl-7-anilinofluoran, 3-piperidino-6-methyl-7-anilinofluoran, 3-ethyl-tolylamino-6-methyl-7-anilinofluoran, 3-ethyl-tolylamino-6-methyl-7-phenylfluoran, 3-diethylamino-7-(4-nitroanilino)fluoran, 3-dibutylamino-6-methyl-7-anilinofluoran, 3-(N-methyl-N-propyl)amino-6-methyl-7-anilinofluoran, 3-(N-ethyl-N-isopropyl)amino-6-methyl-7-anilinofluoran, 3-(N-ethyl-N-tetrahydrofurfuryl)amino-6-methyl-7-anilinofluoran, 3-(N-ethyl-N-isopentyl)amino-6-methyl-7-anilinofluoran; 3-(N-cyclohexyl-N-methyl)-amino-6-methyl-7-anilinofluoran; 3-diethylamino-6-methyl-7-anilinofluoran; 3-dibutylamino-6-methyl-7-aninofluoran; 3-(N-ethyl-N-(3-ethoxy) propyl)-amino-6-methyl-7-anilinofluoran; 3-dipentyl-amino-6-methyl-7-aninofluoran, etc.;

(4) thiazine compounds such as benzoyl leuco methylene blue, p-nitrobenzoyl leuco methylene blue, etc.; and (5) spiro compounds such as 3-methyl-spirodinaphthopyran, 3-ethyl-spirodinaphthopyran, 3,3'-dichlorospirodinaphthopyran, 3-benzyl-spirodinaphthopyran, 3-methylnaphtho-(3-methoxybenzo)spiropyran, 3-propyl-spirodibenzopyran, etc. Also useful are mixtures of these dye precursors.

Preferred electron donating dye precursors suitable for practicing the invention are (i) 3,3-bis(p-dimethylaminophenyl)-6-dimethylaminophthalide, (ii) 3-(N-ethyl-N-isopentyl)-amino-6-methyl-7-anilinofluoran, and (iii) 3-dipentyl-amino-6-methyl-7-aninofluoran.

The electron donating dye precursor can be used in the amount of about 1 to 15%, preferably about 3 to 8%, by weight based on the weight of the coating composition.

ELECTRON ACCEPTING COMPOUND

The thermosensitive recording element of the invention contains an electron accepting compound which is present in either the first or second layers. Electron accepting compounds are also known as acidic developers. Suitable electron accepting compounds are capable of forming color by reacting with an electron donating dye precursor. Such compounds are disclosed in U.S. Pat. Nos. 4,889,841, 4,885,271, and 4,467,336. Specific electron accepting compounds which are acceptable in practicing the invention include phenol derivatives, aromatic carboxylic acid derivatives, N,N'-diarylthiourea derivatives, and polyvalent metal salts such as zinc salts of organic compounds.

Particularly preferred electron accepting compounds are phenol derivatives. Specific examples include p-octylphenol, p-tert-butylphenol, p-phenylphenol, 1,1-bis(p-hydroxyphenyl)-propane, 1,1-bis(hydroxyphenyl)hexane, 1,1-bis(p-hydroxyphenyl)hexane, 2,2-bis(p-hydroxyphenyl)hexane, 1,1-bis(p-hydroxyphenyl)-2-ethylhexane, 2,2-bis(4"-hydroxyphenyl)propane, 2,2-bis(4-hydroxy-3-dichlorophenyl)propane, benzyl p-hydroxybenzoate, ethyl p-hydroxybenzoate, butyl p-hydroxybenzoate, p-p'-dihydroxydiphenylsulfone, 2,2'-diallyl-4,4'-dihydroxydiphenylsulfone, and 2,2'-dimethyl-4,4'-dihydroxydiphenylsulfide. Mixtures of these compounds may also be used.

In practicing the invention preferred electron accepting compounds are (i) 2,2-bis(4'-hydroxyphenyl), (ii) benzyl-p-hydroxybenzoate, and (iii) 2,2'-diallyl-4,4'-dihydroxydiphenylsulfone.

The electron accepting compounds can be used in the amount of 50 to 500%, preferably 100 to 200%, by weight based on the weight of the dye precursor.

BINDERS

The thermosensitive element of the invention contains a binder in both the first and second layers. It is important that the binder in the second layer or outermost layer be compatible with the binder in the first layer. By the term "compatible with the binder" it is meant that the binder in the second layer be either identical to or have similar properties to the binder in the first layer. For example, it is important that the two binders are miscible with one another and that they do not chemically react with one another.

Binders suitable for practicing the invention are organic polymeric binders that are water soluble and have a molecular weight of 20,000 to 200,000. Examples include starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers such as poly(vinyl alcohol-co-vinyl acetate) also known as partially hydrolyzed polyvinyl alcohol, sodium alginate, water soluble phenol formaldehyde resins, styrene-maleic anhydride copolymer, ethylene-maleic anhydride copolymer, ethylene vinyl acetate polymers, etc.; latex type water soluble binders such as styrene-butadiene copolymer, acrylonitrile-butadiene copolymer, methyl acrylate-butadiene copolymer, etc., acrylic resins such as poly(methyl methacrylate/ethyl acrylate/acrylic acid), etc.

The organic polymeric binder is present as an aqueous solution having a concentration of 1 to 20% by weight, preferably 3 to 10% by weight. If the concentration is less than 1%, stability of the dispersed particles will be inferior and cohesion may be caused during the heating step. If the concentration is greater than 20%, the viscosity of the dispersion will increase remarkably thus requiring a large amount of energy to perform the dispersion.

ADDITIVES

Additives may be present in the dye precursor-containing layer and the developer-containing layer. Additives suitable for practicing the invention include pigments, waxes, lubricants, activation cosolvents, higher fatty acid metal salts, surface active agents, mold inhibitors, dispersing agents, UV absorbing agents, fluorescent dyes, optical brighteners, defoaming agents, and the like. Also useful are heat fusible materials which may lower the melting point of the dye precursor or developer to improve color sensitivity at low temperatures. Preferably, the waxes and higher fatty acid metal salts are in the uppermost layer where they assist in preventing the thermosensitive element from sticking to or scratching the thermal head of the recording device.

Useful pigments include diatomaceous earth, talc, kaolin, sintered kaolin, calcium carbonate, magnesium carbonate, titanium oxide, zinc oxide, silicon oxide, aluminum hydroxide, urea-formalin resin, etc.

Suitable heat fusible materials include B-naphthol benzylether, p-benzylbiphenyl, ethylene glycol m-tolyl ether, m-terphenyl, bis (2-(4-methoxy)phenoxyethyl)ether, dibenzyloxalate, di(p-chlorobenzyl) oxalate, di(p-methylbenzyl) oxalate and dibenzyl terephthalate. These heat fusible materials may be used in the amount of 25–500%, preferably 50 to 200%, by weight based on the weight of dye precursor.

Examples of higher fatty acid metal salts are zinc stearate, calcium stearate. Useful waxes include paraffin, oxidized paraffin, polyethylene, oxidized polyethylene, stearic amide and castor wax. Dispersing agents such as sodium dioctylsulfosuccinate, etc.; UV absorbing agents of the benzophenone type, benzotriazole type etc.; and mold inhibitors such as sodium-o-phenylphenate tetrahydrate, etc., are also useful additives.

SUPPORTS

Supports acceptable for practicing the invention are sheet-formed materials such as paper, e.g., 100% bleached hardwood Kraft and bleached softwood Kraft, wood free cotton vellum, and wood-containing paper made translucent either by pulp beating or with additives; transparent films such as polyethylene terephthalate; non-woven cloth; metal foil; and mixtures thereof. Paper is the preferred support.

DISPERSION PREPARATION AND COATING

A process is provided for preparing a thermosensitive recording element comprising a support and at least two layers provided thereon, wherein the first layer comprises a binder and either a substantially colorless, electron donating dye precursor or an electron accepting compound or mixtures thereof and the second layer comprises a binder and either a dye precursor or electron accepting compound. The process for preparing such a thermosensitive element comprises the steps of:

(a) providing a support;

(b) preparing a first dispersion of an aqueous solution of an organic polymeric binder containing a substantially colorless, electron donating dye precursor;

(c) preparing a second dispersion of an aqueous solution of an organic polymeric binder containing an electron accepting compound, wherein the binder is compatible with the binder in (b);

(d) applying either the first or second dispersion or a mixture thereof onto the support;

(e) drying the first applied dispersion to form a first layer on the support;

(f) applying either the first or second dispersion on the first layer formed in step (e); and (g) drying the second applied dispersion to form a second layer.

Dispersions of the dye precursor and electron accepting compound are generally prepared with an aqueous solution of the organic polymeric binder as the dispersion medium. The dye precursor and the electron accepting compound in their respective dispersions preferably have a particle size of about 0.5 to 3μ. The thermal response in the thermosensitive element is generally insufficient if the particle size is greater than 3μ. A particle size less than 0.5μ can either result in fogging or require a significant amount of energy to carry out the dispersion.

The first dispersion applied to the support contains either a dye precursor, an electron accepting compound or mixtures thereof. If both dye precursor and electron accepting compound are present, the ratio of the dye precursor to the electron accepting compound in this layer is in the range of 1:1 to 10:1 and preferably 2:1 to 4:1.

The dispersion containing the dye precursor is prepared by grinding the dye precursor and other suitable additives along with an aqueous solution of an organic polymeric binder in a grinding device such as a ball mill; sand mill, such as a horizontal sand mill; an attritor, etc. Preferably, a horizontal sand mill containing zirconium silicate media is used. The dispersion is subjected to continuous grinding until an average particle size of 0.5–3μ, preferably 0.8–1μ is obtained.

The dispersion containing the electron accepting compound is prepared by grinding the electron accepting compound, an aqueous solution of the organic polymeric binder and suitable additives in one of the above-described grinding devices until the average particle size of 0.5–3μ, preferably 0.8–1μ, is obtained.

Separate dispersions containing either the dye precursor, or the electron accepting compound, or any of the other additives may be prepared by grinding the individual ingredients along with an aqueous solution of the organic polymeric binder in a grinding device until the desired average particle size is reached. Coating dispersions or compositions may then be prepared by blending the individual dispersions in ratios that produce the desired weight percentage of the individual ingredients as a percentage of total weight of the coating dispersion.

The dispersion containing dye precursor, the electron accepting compound, or mixtures thereof is applied, preferably coated, using any conventional coating apparatus, onto a support, preferably paper. The coated support is then dried at about 25° to 50° C., preferably 45° to 50° C. for 2 to 30 minutes, preferably 2 to 5 minutes. The dye precursor in the coated layer is present in the amount of 0.3 $g/m^2$ to 1.6 $g/m^2$, preferably 0.4 $g/m^2$ to 0.8 $g/m^2$. After drying, either the dye precursor-containing dispersion or the electron accepting compound-containing dispersion is applied, preferably coated, onto the dried first applied layer followed by drying under the same conditions. The electron accepting compound in the coated layer is present in the amount of 0.2 $g/m^2$ to 2.7 $g/m^2$, preferably 0.7 $g/m^2$ to 1.3 $g/m^2$. Alternatively, the electron accepting compound is present in an amount equal to 50–500%, preferably 100–200% by weight based on the weight of dye precursor. It is preferred that drying be conducted in such a fashion that the moisture content of the thermosensitive recording element is within the range of from about 5% by weight to about 9% by weight based on the total weight of the recording element.

Additional layers may be applied to the dried recording element thus described to impart different surface characteristics, such as gloss, smoothness, color, resistance to inorganic or organic solvents, or additional abrasion resistance. In an element having more than two layers, it is preferred that the outermost layer of the recording element contain either the dye precursor or the electron accepting compound, but not both. It has been found that the presence of both dye precursor and electron accepting compound in the outermost layer causes the element to become too heat sensitive which can lead to "image bleeding" or "smearing" from the trailing edge of images. The additional layer or layers comprise an organic polymeric binder compatible with the binder in the adjacent layer and an electron accepting compound or a dye precursor. Multiple layers may comprise a first applied layer comprising a dye precursor or an electron accepting compound, and successive layers containing either developer and dye precursor so long as each component is present in at least one of the layers, i.e., "sandwich" compositions of dye precursor/developer/dye precursor or developer/dye precursor/developer as well as combinations of the above, e.g., dye precursor/dye precursor/developer, developer/dye precursor/dye precursor, and dye precursor-developer/developer/dye precursor and developer/dye precursor-developer/dye precursor, etc., are possible. In all cases, the coated elements thus produced show improved resistance to fingernail abrasion compared to conventional thermosensitive recording elements which contain both dye and developer in a single coating.

The outermost layer may also contain additives such as pigments, waxes, higher fatty acid metal salts, optical brighteners, and mixtures thereof. The cumulative amount of electron accepting compound in all layers of the composition should fall in the range of 50–500%, preferably 100–200% by weight based on the total amount of dye precursor used in the coated material.

EXAMPLES

The following examples further illustrate, but do not limit, the invention. The parts and percentages are by weight unless otherwise noted. Average particle size was measured using a Microtrac Model 7998 SPA Particle Size Analyzer, Leads & Northrup Company, St. Petersburg, Fla.

Dispersions A–E were prepared by grinding in a Union Process 1S Attritor, Union Process Company, Akron, Ohio, using 0.12 inch (0.3 cm) stainless steel shot as the grinding media:

Dispersion "A" (Dye Precursor Dispersion):

3-(N-diethyl)-amino-6-methyl-7-anilinofluoran (500 grams) and 2000 grams of 7% (by weight) solution of Polyvinylalcohol in water were ground at a temperature of 25°–37° C. for 4 hours in an attritor equipped with external cooling jacket. The resulting dispersion was shown to have particles of 1.3 micron average diameter.

Dispersion "B" (Sensitizer or Heat Fusible Compound Dispersion):

Parabenzylbiphenyl (460 grams) and 2040 grams of 7% Polyvinylalcohol solution in water were ground in an attritor at a temperature of 25°–35° C., for 6 hours to produce a dispersion whose average particle size was shown to be 1.45 microns in diameter.

Dispersion "C" (Electron Accepting Compound or Developer Dispersion):

p-Hydroxybenzylbenzoate (375 grams) and 2125 grams of a 7% solution of Polyvinylalcohol in water were ground in an attritor at a temperature of 25°–35° C. for 5 hours to produce a dispersion whose average particle size was shown to be 1.54 microns in diameter.

Dispersion "D" (Color Stabilizer Dispersion-DH-43)

1,1,3-Tris (2-methyl-4-hydroxy-5-cyclohexylphenyl)butane (465 grams) and 2035 grams of a 7% solution of Polyvinylalcohol were ground at a temperature of 25°–35° C., for 24 hours in an attritor to produce a dispersion whose average particle size was shown to be 2.5 microns in diameter.

Dispersion "E" (Pigment Dispersion):

Calcium Carbonate (500 grams) and 2000 grams of a 7% solution of Polyvinylalcohol were ground together in an attritor at a temperature of 25°–30° C. for 4 hours to produce a dispersion whose average particle size was shown to be 1.5 micron in diameter.

The following dispersions were prepared by first preparing a preliminary slurry of the individual ingredients described below in the proportions shown using a Cowles mixer (Model W-24, Moorehouse Industries, Los Angeles, Calif.). The individual slurries were then ground in a 20 liter horizontal grinding mill (Model EPH-20 Super Mill, Premier Mill Corporation, Reading, Pa.) using zirconium silicate grinding media of 0.6–0.8 mm particle size. The ingredients were subjected to continuous grinding in this mill at residence times of 10 minutes/liter until analysis showed each dispersion contained particles with average size of 1–2 microns in diameter.

Dispersion "F" (Dye Precursor Dispersion):

3-(N-diethyl)-amino-6-methyl-7-anilinofluoran (29 Kg) and 116 Kg of 7% (by weight) solution of Polyvinylalcohol in water were ground in a Premier Mill at a flow rate of 1.26 l/min. until analysis showed the dispersion contained particles of 1.38μ average size.

Dispersion "G" (Heat Fusible Material) and

Dispersion "H" (Developer):

Using the procedure described to prepare Dispersion F, Dispersion G (20% by weight of parabenzylbiphenyl and 80% by weight of 7% Polyvinylalcohol in water) and Dispersion H (20% by weight of p-hydroxybenzylbenzoate and 80% by weight of 7% Polyvinylalcohol in water) were prepared. Particle size analysis showed these dispersions to contain particles with average size of 1.1μ and 1.3μ respectively.

Dispersions "I", "J", and "K" are identified below:

| DISPERSION | COMPOSITION | TRADE NAME | SUPPLIER |
|---|---|---|---|
| I | Zinc stearate (31.5% in water) | Hidorine D-523 | Cytech Products Inc., Elizabethtown, KY |
| J | Paraffin wax (30% in water) | Hidorine D-338 | Cytech Products Inc., Elizabethtown, KY |
| K | Arkls DH-43 (30% in water) | Hidorine F-165 | Cytech Products Inc., Elizabethtown, KY |

Dispersion "L" (Dye Precursor and Heat Fusible Material):

3-(N-diethyl)-amino-6-methyl-7-anilinofluoran (58 Kg), parabenzylbiphenyl (58 Kg) and 230 Kg of 7% (by weight) solution of Polyvinylalcohol in water were mixed in with Cowles mixer and the resulting slurry was ground in a Premier Mill until analysis showed average particle size of 1.89μ.

The following dispersions were prepared by the procedure described for Dispersion F:

Dispersion "M" (Electron Accepting Compound):

| INGREDIENT | WEIGHT % |
|---|---|
| 2,2-Bis(4'-hydroxyphenyl)propane (BPA) | 20 |
| Polyvinylalcohol (7% solution in water) | 60 |
| Water | 20 |

Average particle size meter grinding: 1.35μ

Dispersion "N" (Electron Accepting Compound):

| INGREDIENT | WEIGHT % |
|---|---|
| BPA | 20 |
| Hydroxyethyl cellulose (3% solution in water) | 60 |
| Water | 20 |

Average particle size after grinding: 1.50μ

Dispersion "O" (Dye Precursor):

| INGREDIENT | WEIGHT % |
|---|---|
| 3-dipentylamino-6-methyl-7-anilinofluoran | 20 |
| Polyvinylalcohol (7% solution in water) | 65 |
| Water | 15 |

Dispersions "P", "Q", "R", and "S" were prepared by the procedure described for Dispersion F and had the following compositions:

| | AMOUNT (WEIGHT %) | | | |
|---|---|---|---|---|
| INGREDIENT | P | Q | R | S |
| 3-(N-diethyl-amino)-6-methyl-7-anilinofluoran | 6.2 | — | — | — |
| 3-Dipentylamino-6-methyl-7-aninofluoran | — | — | — | 6.0 |
| Parabenzylbiphenyl | 6.2 | — | — | 6.0 |
| p-hydroxybenzylbenzoate | — | 6.0 | — | — |
| Bisphenol-A(BPA) | — | — | 6.0 | — |
| Polyvinylalcohol (7% in water) | 73.3 | 79.3 | 70.4 | 80.0 |
| Water | 14.3 | 14.7 | 23.6 | 8.0 |

EXAMPLE 1

A coating composition was prepared by diluting Dispersion A with an aqueous solution of polyvinylalcohol. It had the following composition:

| INGREDIENTS | WEIGHT % |
|---|---|
| Dispersion A | 8.3 |
| Polyvinylalcohol (7% in water) | 91.7 |

The coating composition was used to coat 81.6 g/m$^2$ base paper using a Meyer Rod. The coating, was then air dried for 30 minutes at 27° C. The resulting coating was white in color with a high gloss and was shown to have a coating weight of 1.4 g/m$^2$.

A second coating composition was prepared by diluting Dispersion C with an aqueous solution of polyvinylalcohol. It had the following composition:

| INGREDIENTS | WEIGHT % |
|---|---|
| Dispersion C | 33.2 |
| Polyvinylalcohol (7% in water) | 66.8 |

The coating composition was used to apply a second layer over the already coated and dried dye precursor-containing layer on paper again using a Meyer Rod, followed by air drying for 30 minutes at 27° C. The resulting coated paper, with a total coat weight of 2.9 g/m$^2$ was white in color, had low gloss, and was remarkably resistant to scratching by fingernail abrasion. No image developed when rubbed vigorously with the fingernail. By contrast, standard thermal paper was readily marked by even gentle rubbing with a fingernail. The coated paper was shown to have a background of 0.05 O.D. units, measured by reflectance densitometry, and produced a black image having an absorbance of 0.67 O.D. units, in a Gulton Model SP80 ATSBI thermal printer, Gulton Co., East Greenwich, R.I.

EXAMPLE 2

A thermosensitive recording element was prepared as described in Example 1 with the following exception: the dye precursor-containing layer had the following composition:

| INGREDIENTS | WEIGHT % |
|---|---|
| Dispersion A | 16.5 |
| Dispersion B | 61.2 |
| Polyvinylalcohol (7% in water) | 22.3 |

The thermosensitive element was smooth, "creamy" colored, and had low gloss. Although somewhat less resistant to scratching than the element in Example 1, it was much more resistant to abrasion than standard thermal coatings. The coated paper showed background absorbance of 0.06 O.D. When printed in the Gulton thermal printer, it gave black images with optical density of 1.26 O.D. units.

EXAMPLE 3

Dispersions F–H were used to prepare the following coating compositions:

| INGREDIENT | WEIGHT % |
|---|---|
| COATING COMPOSITION I (Dye Precursor & Heat Fusible Material) | |
| Dispersion F | 30.0 |
| Dispersion G | 30.0 |
| Polyvinylalcohol (7% in water) | 32.0 |
| Water | 8.0 |
| COATING COMPOSITION 2 (Developer) | |
| Dispersion H | 30.0 |
| Polyvinylalcohol (7% in water) | 56.0 |
| Water | 14.0 |
| COATING COMPOSITION 3 (Dye Precursor, Heat Fusible Material, & Developer) | |
| Dispersion F | 30.0 |
| Dispersion G | 30.0 |
| Dispersion H | 30.0 |
| Polyvinylalcohol (7% in water) | 10.0 |

Supports of bleached Kraft paper with a basis weight of 89.6 g/m$^2$ were used with the above coating compositions as follows:

SAMPLE 1

Coating Composition 1 was applied to the support using a Meyer Rod. The coating was air dried at ambient temperature for 30 minutes. The coating was white in color and was shown to have a coating weight of 2.28 g/m$^2$.

Coating Composition 2 was applied as a second coat to the sample containing the Composition 1 coated and dried layer using a Meyer Rod. The second coating was air dried as described above and was shown to have a coat weight of 1.63 g/m$^2$ (total coating weight=3.9 g/m$^2$). The coated sample was white in color with background reflective density of 0.04 O.D. The coated sampel showed excellent resistance to fingernail abrasion. When printed in a Gulton Thermal Printer, images with optical density of 1.35 O.D. were obtained.

SAMPLE 2 (Control)

Coating Composition 3 was used to apply a single coating layer to a support of bleached Kraft paper with a basis weight of 81.6 g/m$^2$. The coating was air dried at ambient temperature for 30 minutes. The resulting coated sample was blue gray in color with a background of 0.15 O.C. by reflective densitometry. This sample had a coating weight of 3.9 g/m$^2$. The coated sample easily marked with even gentle rubbing with a fingernail. Printed in a Gulton Printer, the coated sample gave images of 1.29 O.D. units.

EXAMPLE 4

Dispersions F–K were used to prepare coating compositions as shown below:

| INGREDIENT | WEIGHT % |
|---|---|
| COATING COMPOSITION 4 (Dye and Heat Fusible Material) | |
| 3-(N-diethyl)-amino-6-methyl-7-anilinofluoran | 6.0 |
| Parabenzylbiphenyl | 6.0 |
| Polyvinylalcohol (7% in water) | 73.2 |
| Water | 14.7 |
| COATING COMPOSITION 5 (Developer) | |
| p-Hydroxybenzylbenzoate | 6.0 |
| Polyvinylalcohol (7% in water) | 79.3 |
| Water | 14.7 |
| COATING COMPOSITION 6 (Developer & Zinc Stearate & Paraffin & Arkls DH-43) | |
| p-Hydroxybenzylbenzoate | 6.0 |
| Zinc stearate (from Dispersion I) | 10.0 |
| Paraffin wax (from Dispersion J) | 10.0 |
| Arkls DH-43 (from Dispersion K) | 1.0 |
| Polyvinylalcohol (7% in water) | 25.4 |
| Water | 47.6 |
| COATING COMPOSITION 7 (Developer & Pigment & Optical Brightener) | |
| p-Hydroxybenzylbenzoate | 5.5 |
| Calcium carbonate | 12.9 |
| Calcaflour dye | 1.0 |
| Carboset ® XL-11 (Acrylic/methacrylic acid polymers) B. F. Goodrich Co., Cleveland, OH | 3.5 |
| Polyvinylalcohol (7% in water) | 25.4 |
| Water | 51.7 |
| COATING COMPOSITION 8 (Developer & Activator & Pigment) | |
| p-Hydroxybenzylbenzoate | 5.0 |
| Parabenzylbiphenyl | 1.7 |
| Calcium carbonate | 9.3 |
| Polyvinylalcohol (7% in water) | 84.0 |

Coating Composition 4 (dye and heat fusible material) was used to coat 81.6 g/m$^2$ base paper using a Meyer Rod. The coating was dried in an air oven at web temperature of 58° C. for 5 minutes. Analysis showed a coating weight 1.79 g/m$^2$.

The coated paper was further coated with Coating Composition 5 (developer) in two stages. First Coating Composition 5 was applied using a Meyer Rod and this coated paper was dried in an air oven at web temperature of 48° C. for 5 minutes. Analysis showed this process gave a coat weight of 1.15 g/m$^2$. The paper was then further coated with Coating Composition 5 using a Meyer Rod and again was air dried at web temperature of 48° C. for 5 minutes. Analysis showed that this third coating had a coat weight of 1.46 g/m$^2$.

The resulting thermosensitive element comprising a support and three coated layers had a total coating weight of 4.4 g/m$^2$. The element was white in color and had a background reflective density of 0.05 O.D. In addition, the element showed excellent resistance to fingernail abrasion. When this coated sample was printed in a Gulton Printer, images with optical densities of 1.41 O.D. were obtained.

EXAMPLE 5

Example 4 was repeated with the following exception: the final coating was made with Coating Composition 6 instead of Coating Composition 5. Analysis showed that the 3 coatings were present in the amounts of 1.55 g/m$^2$, 1.79 g/m$^2$, and 1.30 g/m$^2$ respectively. The resulting coated element was white in color and the background optical density was 0.04 O.D. The element was resistant to fingernail abrasion. When printed in a Gulton Thermal Printer, this coated element gave images with optical density of 1.38 O.D.

EXAMPLE 6

Example 4 was repeated with the following exception: Coating Composition 7 was applied to dried Coating Composition 4 instead of Coating Composition 5. The resulting coated element was shown to contain coatings in the amount of 1.30 g/m$^2$, 1.95 g/m$^2$, and 1.59 g/m$^2$ respectively. The coated element was white in color and had a background of 0.06 O.D. The element had excellent resistance to fingernail abrasion. When printed in the Gulton Thermal Printer it gave images with optical density of 1.32 O.D.

EXAMPLE 7

By blending various amounts of Dispersions A–E, described above, the following coating compositions were produced with the indicated weight percentage of each ingredient:

TABLE 1

| Ingredient | Weight Percent COMPOSITION NO.: 8 | 9 | 10 | 11 | 12 | 13 |
|---|---|---|---|---|---|---|
| 3-N-diethyl-amino-6-methyl-7-anilino-fluoran (A) | 1.8 | — | — | — | 1.6 | 1.7 |
| p-Hydroxybenzyl-benzoate (C) | — | 4.9 | 5.1 | 5.0 | — | — |
| Parabenzylbiphenyl (B) | — | 1.7 | — | 1.7 | — | — |
| Arkls DH-43 (D) | — | — | — | — | 1.2 | — |
| Calcium carbonate | 9.3 | — | 9.2 | 9.2 | — | — |
| Polyvinylalcohol (7% in water) | 88.9 | 93.4 | 85.7 | 84.1 | 97.2 | 98.3 |

Coating compositions Nos. 8 through 13 were used to coat samples of 57 g/m$^2$ base paper as shown in Table 2. In each case after the first coating was applied, the coated sample was air dried at room temperature under forced air drying for 30 minutes. The second coating was then applied and the coated element was again forced air dried at room temperature for 30 minutes. The sample was then evaluated for coating weight, resistance to fingernail abrasion, background absorbance and were then printed in a Gulton Printer. Results are shown in Table 2.

TABLE 2

| SAMPLE NUMBER | 1 | 2 | 3 | 4 | 5 | 6 | 7 | 8 |
|---|---|---|---|---|---|---|---|---|
| COMPOSITION No. 1ST APPLICATION | 13 | 8 | 13 | 8 | 13 | 8 | 12 | 12 |
| COAT WEIGHT (g/m$^2$) 1ST APPLICATION: | 1.14 | 2.77 | 1.14 | 2.77 | 1.14 | 2.77 | 1.30 | 1.30 |
| COMPOSITION No. 2ND APPLICATION | 9 | 9 | 10 | 10 | 11 | 11 | 9 | 11 |
| COAT WEIGHT (g/m$^2$) 2ND APPLICATION | 2.44 | 1.14 | 1.95 | 4.72 | 1.63 | 4.56 | 1.95 | 1.95 |
| BACKGROUND O.D. | 0.04 | 0.05 | 0.05 | 0.05 | 0.05 | 0.05 | 0.04 | 0.04 |
| IMAGE O.D. | 0.59 | 0.61 | 0.48 | 0.52 | 0.58 | 0.67 | 0.64 | 0.64 |
| ABRASION RESISTANCE | +++ | +++ | + | ++ | + | ++ | +++ | +++ |

Abrasion Resistance: + = Good; ++ = Very Good; +++ = Excellent

EXAMPLE 8

Dispersions A, I, J, K, M, N, and O may be blended together in appropriate amounts to produce the coating compositions with indicated weight percent shown in Table 3.

TABLE 3

| Ingredient | Weight Percent COMPOSITION NUMBER: 14 | 15 | 16 | 17 | 18 |
|---|---|---|---|---|---|
| 3-N-diethyl-amino-6-methyl-7-anilinofluoran | 6.0 | — | — | — | — |
| 3-Dipentylamino-6-methyl-7-anilinofluoran | — | 6.0 | — | — | — |
| BPA | — | — | 8.0 | 8.0 | 8.0 |
| Calcium carbonate | 10.0 | — | — | — | — |
| Zinc stearate | — | — | 8.0 | 8.0 | — |
| Paraffin wax | — | — | 8.0 | 8.0 | — |
| Arkls DH-43 | 1.0 | 1.0 | 1.0 | — | — |
| Hydroxyethyl cellulose (3% in water) | — | — | — | 2.0 | — |
| Polyvinylalcohol (7% in water) | 83 | 93 | 75 | 64 | 92 |
| Joncryl ® 58, | — | — | — | 10 | 0 |

TABLE 3-continued

| Ingredient | Weight Percent COMPOSITION NUMBER: 14 | 15 | 16 | 17 | 18 |
|---|---|---|---|---|---|
| Acrylic/methacrylate copolymer - M.W. 4900, Acid No. 215, S. C. Johnson and Son, Racine, WI | | | | | |

Coating compositions shown in Table 3 are used to coat samples of 57 g/m$^2$ base paper as described in Example 7, and are evaluated for coating weight, abrasion resistance, and background absorbance. The optical density can be measured of images produced when the samples are printed in a Gulton Printer. These thermosensitive recording elements are expected to have good abrasion resistance, background absorbance and optical density.

EXAMPLE 9

Dispersions P, Q, R, and S were used to make the following thermosensitive recording elements as described in Example 1 with the following exceptions:

| SAMPLE NO. | LAYER NO. 1 | LAYER NO. 2 | LAYER NO. 3 |
|---|---|---|---|
| 1 | Dispersion P | Dispersion Q | — |
| 2 | Dispersion P | Dispersion Q | Dispersion Q |
| 3 | Dispersion Q | Dispersion P | — |
| 4 | Dispersion Q | Dispersion P | Dispersion Q |
| 5 (Comparative Sample) | Dispersion P + Dispersion Q | — | — |
| 6 | Dispersion P | Dispersion R | — |
| 7 | Dispersion R | Dispersion P | Dispersion P |
| 8 | Dispersion R | Dispersion P | Dispersion R |
| 9 (Comparative Sample) | Dispersion P + Dispersion R | — | — |
| 10 | Dispersion S | Dispersion R | — |
| 11 | Dispersion R | Dispersion S | — |
| 12 | Dispersion R | Dispersion S | Dispersion S |
| 13 (Comparative Sample) | Dispersion R + Dispersion S | — | — |

The elements were tested as described in Example 7 and the results are shown in Table 4.

TABLE 4

| SAMPLE No. | ABRASION RESISTANCE | BACKGROUND O.D | IMAGE O.D |
|---|---|---|---|
| 1 | ++ | 0.14 | 1.31 |
| 2 | ++ | 0.15 | 1.31 |
| 3 | +++ | 0.08 | 1.37 |
| 4 | + | 0.08 | 1.42 |
| 5 | 0 | 0.15 | 1.29 |
| 6 | + | 0.18 | 1.35 |
| 7 | ++ | 0.07 | 1.22 |
| 8 | + | 0.10 | 1.49 |
| 9 | 0 | 0.11 | 1.07 |
| 10 | ++ | 0.08 | 1.06 |
| 11 | +++ | 0.08 | 0.98 |
| 12 | +++ | 0.08 | 0.75 |
| 13 | 0 | 0.07 | 1.10 |

Abrasion Resistance: + = Good; ++ = Very Good; +++ = Excellent

What is claimed is:

1. A thermosensitive recording element having improved abrasion resistance, said element comprising:

(a) a support;

(b) a first coating composition layer consisting essentially of an organic polymeric binder and a substantially colorless electron donating dye precursor, said dye precursor present in the amount of about 1 to 15% by weight based on the weight of the coating composition; and (c) a second coating composition layer consisting essentially of an organic polymeric binder compatible with the binder in (b) and an electron accepting compound, said electron accepting compound present in the amount of about 50 to 500% by weight based on the weight of said dye precursor;

said organic polymeric binder in said first and second layers are water soluble binders having a molecular weight of 20,000 to 200,000 and are each applied from aqueous solutions having a concentration of 1 to 20% by weight;

wherein said first layer is interposed between said support and said second layer.

2. The thermosensitive recording element of claim 1 wherein said substantially colorless electron donating dye precursor is selected from the group consisting of triarylmethane compounds, diphenylmethane compounds, xanthene compounds, thiazine compounds and spiro compounds.

3. The thermosensitive recording element of claim 2 wherein said substantially colorless electron donating dye precursor is 3,3-bis(p-dimethylaminophenyl)-6-dimethylaminophthalide.

4. The thermosensitive recording element of claim 2 wherein said substantially colorless electron donating dye precursor is 3-(N-ethyl-N-isopentyl) -amino-6-methyl-7-anilinofluoran.

5. The thermosensitive recording element of claim 2 wherein said substantially colorless electron donating dye precursor is 3-dipentyl-amino-6-methyl-7-anilinofluoran.

6. The thermosensitive recording element of claim 1 wherein said substantially colorless electron donating dye precursor is present in the amount of about 3 to 8% by weight based on the weight of said coating composition.

7. The thermosensitive recording element of claim 1 wherein said electron accepting compound is selected from the group consisting of phenol derivatives, aromatic carboxylic acid derivatives, N,N'-diarylthiourea derivatives, and polyvalent metal salts.

8. The thermosensitive recording element of claim 7 wherein said electron accepting compound is 2,2-bis(4'-hydroxyphenyl)propane.

9. The thermosensitive recording element of claim 7 wherein said electron accepting compound is benzyl p-hydroxybenzoate.

10. The thermosensitive recording element of claim 7 wherein said electron accepting compound is 2,2'-diallyl-4,4'-dihydroxydiphenylsulfone.

11. The thermosensitive recording element of claim 1 wherein said organic polymeric binder is selected from the group consisting of starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers, sodium alginate, water soluble phenol formaldehyde resins, styrene-maleic anhydride copolymer, ethylene-maleic anhydride copolymer, ethylene vinyl acetate polymers, styrene-butadiene copolymer, acrylonitrile-butadiene copolymer and acrylic resins.

12. The thermosensitive recording element of claim 1 wherein said organic polymeric binder is applied from an aqueous solution having a concentration of 3 to 10% by weight.

13. The thermosensitive recording element of claim 1 further comprising heat fusible materials.

14. The thermosensitive recording element of claim 1 wherein said support is a sheet-formed material.

15. The thermosensitive recording element of claim 14 wherein said support is selected from the group consisting of paper, transparent films, non-woven cloth, metal foil and composites thereof.

16. The thermosensitive recording element of claim 1 wherein at least one additional coating composition layer (d) is present on said second layer, said additional layer comprising an organic polymeric binder and either a substantially colorless electron donating dye precursor or an electron accepting compound.

17. The thermosensitive recording element of claim 16 wherein said additional layer comprises an organic polymeric binder and an electron accepting compound.

18. The thermosensitive recording element of claim 17 wherein said additional layer comprises at least one compound selected from the group consisting of pigments, waxes, higher fatty acid metal salts and optical brighteners.

19. The thermosensitive recording element of claim 16 wherein said additional layer comprises an organic polymeric binder and a substantially colorless electron donating dye precursor.

20. The thermosensitive recording element of claim 19 wherein said additional layer comprises at least one compound selected from the group consisting of pigments, waxes, higher fatty acid metal salts and optical brighteners.

21. The thermosensitive recording element of claim 16 wherein said additional layer comprises at least one compound selected from the group consisting of pigments, waxes, higher fatty acid metal salts and optical brighteners.

22. The thermosensitive recording element of claim 1, wherein said dye precursor and said electron accepting compound have a particle size of about 0.5 to about 3 microns.

23. The thermosensitive recording element of claim 1 wherein said dye precursor is present in the coated layer in the amount of about 0.3 $g/m^2$to 1.6 $g/m^2$.

24. The thermosensitive recording element of claim 1 wherein said electron accepting compound is present in the coated layer in the amount of about 0.2 $g/m^2$to 2.7 $g/m^2$.

* * * * *

UNITED STATES PATENT AND TRADEMARK OFFICE

CERTIFICATE OF CORRECTION

PATENT NO. : 5,610,118

DATED : March 11, 1997

INVENTOR(S) : Albert H. Smith

It is certified that error appears in the above-identified patent and that said Letters Patent is hereby corrected as shown below:

Column 4, line 14, change "2,2-bis (4"-hydroxyphenyl) propane" to --2,2-bis (4'-hydroxyphenyl)propane--;

Column 11, line 15, change "sampel" to --sample--,

Column 11, line 24, change "0.15 O.C." to --0.15 O.D.--

Signed and Sealed this

Twenty-second Day of July, 1997

Bruce Lehman

*Attest:*

BRUCE LEHMAN

*Attesting Officer*

*Commissioner of Patents and Trademarks*